US005901418A

United States Patent [19]

Hopkins

[11] Patent Number: 5,901,418

[45] Date of Patent: May 11, 1999

[54] QUICK RELEASE CLAMP FOR INFLATABLES

[75] Inventor: William K. Hopkins, San Clemente, Calif.

[73] Assignee: Fastening Solutions, Inc., Van Nuys, Calif.

[21] Appl. No.: 09/112,852

[22] Filed: Jul. 10, 1998

Related U.S. Application Data

[ 60] Provisional application No. 60/052,912, Jul. 14, 1997.

[51] Int. Cl.[6] ..... A44B 11/00

[52] U.S. Cl. ..... 24/302; 24/164; 24/300

[58] Field of Search ..... 24/302, 300, 164; 224/250; 128/DIG. 26, 348

[56] References Cited

U.S. PATENT DOCUMENTS

| | | | |
|---|---|---|---|
| 786,080 | 3/1905 | Wing . | |
| 1,530,342 | 3/1925 | Barber . | |
| 2,931,084 | 4/1960 | De Witt | 24/302 |
| 3,439,387 | 4/1969 | Churches | 24/300 |
| 3,486,672 | 12/1969 | Esopi | 224/25 |
| 4,165,748 | 8/1979 | Johnson | 128/348 |
| 5,083,692 | 1/1992 | Treese | 224/205 |
| 5,100,393 | 3/1992 | Johnson | 24/302 |
| 5,331,721 | 7/1994 | Raum, Sr. | 24/3 |
| 5,725,009 | 3/1998 | Mallow, Sr. et al. | 24/300 |
| 5,740,591 | 4/1998 | Hopkins | 24/302 |

FOREIGN PATENT DOCUMENTS

| | | |
|---|---|---|
| 1333646 | 6/1963 | France . |
| 685348 | 2/1967 | France . |
| 164981 | 6/1921 | United Kingdom . |

*Primary Examiner*—Victor N. Sakran

*Attorney, Agent, or Firm*—Oppenheimer Wolff & Donnelly LLP

[57] ABSTRACT

A quick release clamp for inflatables or the like having a clamp fixed to a patch adapted to be secured to an inflatable. The clamp has a base portion having a cavity therein and a pair of integral spaced upstanding side walls on opposite sides of the cavity, a latch pivotally mounted to the clamp between the spaced side walls, the latch having a handle end and a protrusion fixed to the handle. The patch may be secured to an inflatable. A similar clamp, having a strap portion secured thereto, may be quickly and easily connected to the clamp mounted to a patch. The strap portion locks to the clamp secured to the patch and the other protrusion thereon locking into an opening in the patch, clamping the strap portion therebetween.

12 Claims, 2 Drawing Sheets

QUICK RELEASE CLAMP FOR INFLATABLES

This application claims benefit of Provisional Appln. No. 60/052,912, filed Jul. 14, 1997.

BACKGROUND OF THE INVENTION

1. Field of the Invention

The invention relates to inflatables; and, more particularly, to a quick release clamp secured to a patch for use with inflatables.

2. Description of the Prior Art

Inflatables, much as boats, are well known in the art. Generally, such inflatables have a patch or the like with a ring or loop for securing a mooring line thereto.

However, it is not easy to secure such lines, particularly in wet conditions, such as on a boat or the like.

In my U.S. Pat. No. 5,740,591, issued Apr. 21, 1998, I disclose a strap having a fastener or clamp particularly useful on boats or the like. Such a clamp could be used on inflatables such as boats or float tubes.

SUMMARY OF THE INVENTION

It is an object of this invention to provide a quick release clamp useful on inflatables.

These and other objects are preferably accomplished by providing a clamp fixedly secured to a patch adapted to be mounted to the inflatable. Another clamp, having a strap secured thereto, may be adjustably connected to the clamp on the patch.

DESCRIPTION OF THE PREFERRED EMBODIMENTS

Figure 1:
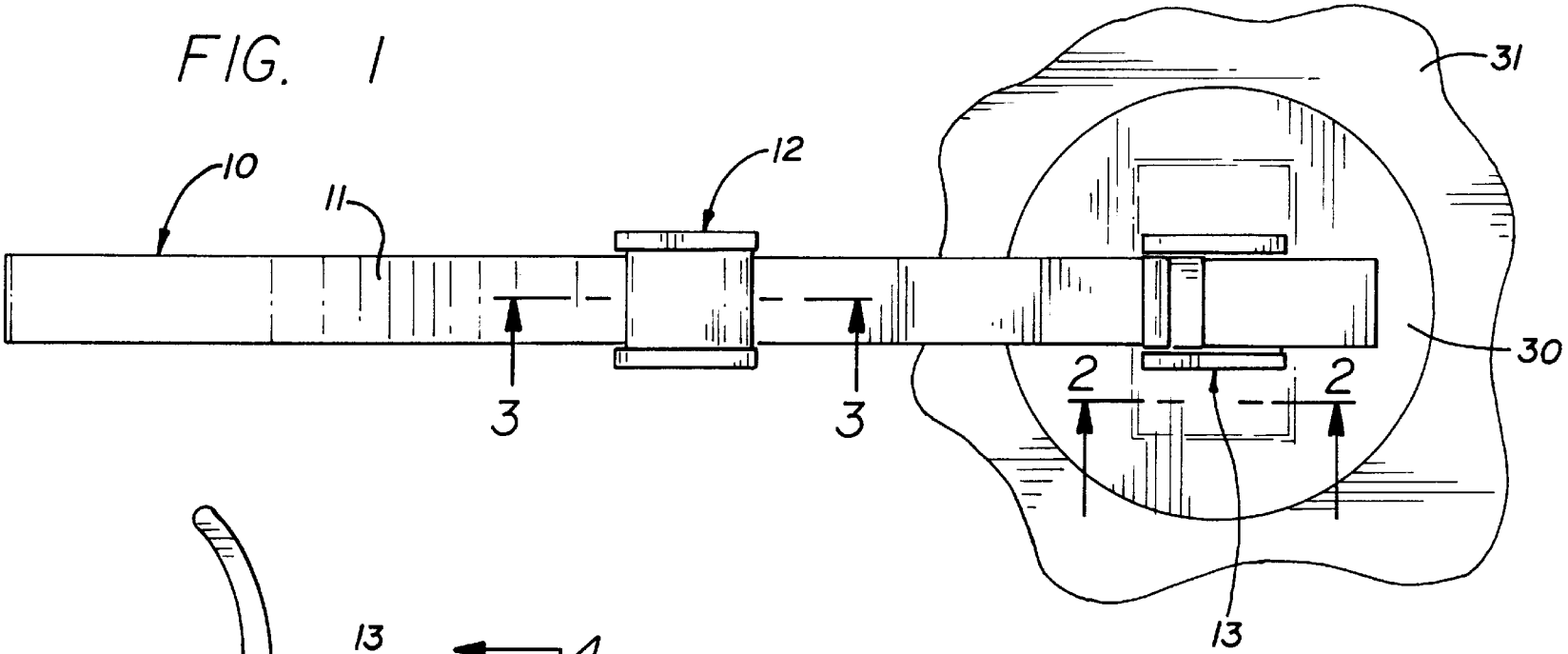
FIG. 1 is a plan view of a patch mounted to an inflatable having a clamp thereon in accordance with the teachings of the invention, another clamp with a strap being secured thereto.

Referring now to FIG. 1 of the drawing, a strap 10 is shown having an elongated flexible strap portion 11. Strap portion 11 has a clamp 12 fixed to strap portion 11 at any suitable location.

Figure 3:
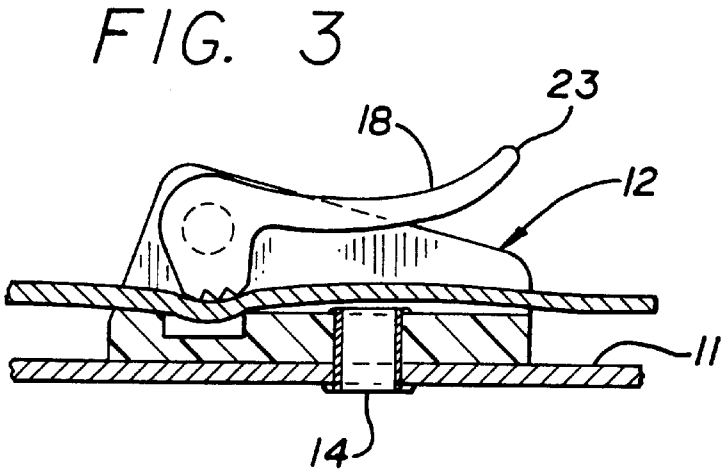
Figure 4:
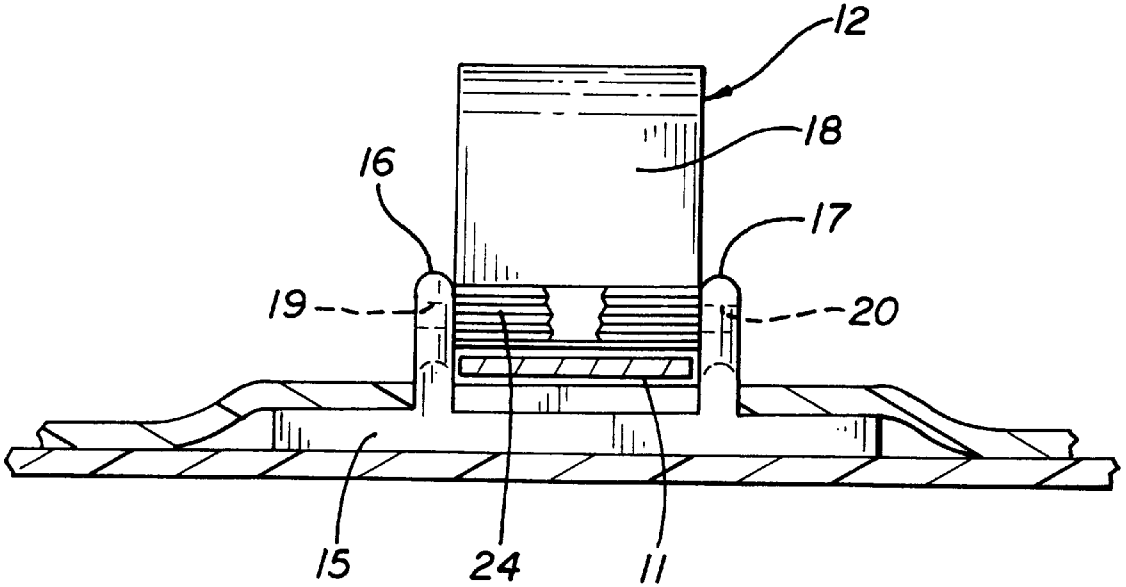
FIG. 4 is a side view, partly in section, illustrating the operation of one of the clamps of FIGS. 1–3.

Clamp 12 is secured to strap portion 11 by a rivet 14 or the like (see FIG. 3). Clamp 12 includes a base portion 15 having spaced integral upstanding side walls 16, 17 (FIG. 4). A latch 18 is pivotally mounted between side walls 16, 17. Any suitable means may be used to pivotally mount latch 18. For example, latch 18 may have pin portions 19 integral therewith extending into holes 20 formed in side walls 16, 17, respectively. As particularly seen in FIG. 3, latch 18 terminates at one end in an upwardly curved end 23 and at the other end in a protrusion 24. As seen in FIG. 3, strap portion 11 passes between latch 18 and base portion 15. When end 23 is grasped and latch 18 is pivoted to the FIG. 3 position, protrusion 24 abuts against strap portion 11 locking strap portion 11 in place in the cavity 40 in base 15.

Figure 2:
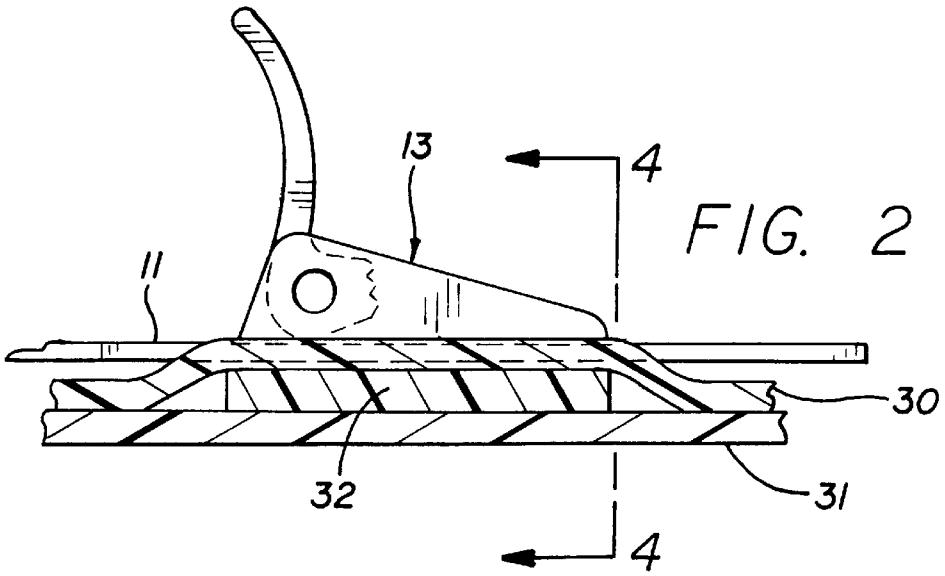
FIGS. 2 and 3 are views taken along lines 2—2 and 3—3 of FIG. 1, respectively.

As seen in FIG. 2, clamp 13 is essentially identical to clamp 12 and operates in like manner. However, as particularly contemplated in the invention, clamp 13 is secured to a patch 30 which in turn is adapted to be secured to an inflatable 31 (only a portion being shown), such as boat or tube.

Also as seen in FIG. 2, base 32 extends through a hole 33 in patch 30 and the base 32 and patch 30 is glued or otherwise secured to inflatable 31 at any suitable location.

Inflatable 31 may be part of a complete boat or other type of float or the like. The free end of strap portion 11 may be secured to clamp 13 as shown in FIG. 2. Thus, the clamp 13 and patch 30 may be provided as a kit adapted to be secured, as by gluing patch 30 in position, to an inflatable. The clamp 12, with strap position 11 attached thereto, may or may not be part of the kit. Also, other strap and clamp arrangements may be provided secured to clamp 13. The complete operation of locking strap 10 is similar to that of strap 10 described and claimed in my U.S. Pat. No. 5,740,591, the teachings of which are incorporated herein by reference.

Although a particular embodiment of the invention is disclosed, variations thereof may occur to an artisan and the scope of the invention should only be limited by the scope of the appended claims.

I claim:

1. A quick release strap for inflatables fixedly secured thereto, the inflatable comprising a housing having an air filled inner chamber normally closed by closable air inlet leading into the interior of said chamber comprising:

an elongated flexible strap portion having a first clamp fixedly mounted thereon adjacent one end thereof;

a second clamp fixedly secured to a patch fixed to said inflatable;

each of said clamps including a base portion having a cavity therein and a pair of integral spaced upstanding side walls on opposite sides of said cavity, a latch pivotally mounted to each of said clamps between said spaced side walls, each of said latches having a handle end and a protrusion fixed to said handle, said strap portion passing between each of said latches and its respective base portion, the first clamp being spaced from said second clamp, said protrusion on the second clamp being disposed above the cavity therein and normally disposed in a position out of said cavity, the strap portion passing through said first clamp passing over said cavity therein whereby, when said latch of said first clamp is pivoted, said protrusion moves into said cavity clamping said strap portion between said protrusion and said cavity; and said second clamp being mounted in an opening in said patch secured to said inflatable, said protrusion on said second clamp being disposed above said opening in said patch and normally disposed in a position out of said opening, the strap portion passing through said second clamp passing over said opening whereby, when said latch of said second clamp is pivoted, said protrusion moves into said opening clamping said strap portion between said protrusion and said opening.

2. The strap of claim 1 wherein said protrusion has a plurality of teeth thereon engaging said strap portion when said latch is pivoted to a position wherein said protrusion engages said strap portion.

3. The strap of claim 1 wherein said handle ends of said latches are curved.

4. The strap of claim 1 wherein said first clamp is riveted to said strap portion.

5. The strap of claim 4 wherein said second clamp is glued to said patch.

6. The strap of claim 1 wherein said second clamp is glued to said patch.

7. The strap of claim 1 wherein said latch is substantially as wide as the spacing between said side walls.

8. A quick release clamping system for inflatables fixed to the same, said inflatable comprising a housing having an air filled inner chamber normally closed by a closable air inlet leading into the interior of said chamber comprising:

a patch secured to an inflatable; and a quick release clamp secured in an opening in said patch, said clamp including a base portion having a cavity therein and a pair of integral spaced upstanding side walls on opposite sides of said cavity, a latch pivotally mounted to each of said clamps between said spaced side walls, said latch having a handle end and a protrusion fixed to said handle, said strap portion passing between said latch and its base portion, said protrusion being disposed above said opening in said patch and normally disposed in a position out of said opening whereby, when said latch is pivoted, said protrusion moves into said opening.

9. The system of claim 8 wherein said protrusion has a plurality of teeth thereon.

10. The system of claim 8 wherein said handle end of said latch is curved.

11. The system of claim 8 wherein said clamp is glued to said patch.

12. The system of claim 8 wherein said latch is substantially as wide as the spacing between said side walls.

* * * * *